US012808590B2

(12) United States Patent
Savasci et al.

(10) Patent No.: US 12,808,590 B2
(45) Date of Patent: Nov. 24, 2026

(54) ICE MAKER ASSEMBLY CONFIGURATION AND COOLING APPLIANCE

(71) Applicant: BSH Hausgeräte GmbH, Munich (DE)

(72) Inventors: Özgür Savasci, Tekirdag (AR); Cengizhan Kucukarslan, Tekirdag (AR); Enis Sinan Erkan, Istanbul (AR)

(73) Assignee: BSH Hausgeräte GmbH, Munich (DE)

( * ) Notice: Subject to any disclaimer, the term of this patent is extended or adjusted under 35 U.S.C. 154(b) by 196 days.

(21) Appl. No.: 18/446,892

(22) Filed: Aug. 9, 2023

(65) Prior Publication Data

US 2024/0085077 A1 Mar. 14, 2024

(30) Foreign Application Priority Data

Aug. 16, 2022 (TR) ..... 2022/012930

(51) Int. Cl.
*F25C 1/04* (2018.01)
*F25C 1/25* (2018.01)

(52) U.S. Cl.
CPC ..... *F25C 1/04* (2013.01); *F25C 1/25* (2018.01); *F25C 2305/022* (2013.01); *F25C 2400/10* (2013.01)

(58) Field of Classification Search
CPC ..... F25C 1/04; F25C 1/25; F25C 2305/022; F25C 2400/10; F25C 5/22; F25D 23/067
See application file for complete search history.

(56) References Cited

U.S. PATENT DOCUMENTS 7,591,141 B2 * 9/2009 Wetekamp et al. ..... F25D 11/02 62/340
11,543,166 B2 1/2023 Olvera et al.
2009/0229298 A1 * 9/2009 Allard et al. ..... H05K 5/0247 62/449
2011/0138843 A1 6/2011 Howe et al.
(Continued)

FOREIGN PATENT DOCUMENTS

CN 105423689 A * 3/2016
CN 112197499 A * 1/2021 ..... F25D 31/002
(Continued)

OTHER PUBLICATIONS

Kaneoka, Automatic Ice Manufacturing Device, Apr. 5, 1994, JP H0694339 A, Whole Document (Year: 1994).*
(Continued)

*Primary Examiner* — Jerry-Daryl Fletcher
*Assistant Examiner* — Adam Dorrel Moore
(74) *Attorney, Agent, or Firm* — Laurence A. Greenberg; Werner H. Stemer; Ralph E. Locher

(57) ABSTRACT

A cooling appliance has a cooling compartment to be provided with one or more ice makers. The cooling appliance has a frame for engagement with the ice maker. The frame is adapted to removably engage with a rear panel of the cooling compartment distal from an access opening of the cooling compartment. The cooling appliance further includes a support element to be secured to the rear panel, arranged for supporting the frame against the force of gravity. The frame has two or more guides at its rear panel-side end. The support element is formed with two or more guide channels for receiving and guiding the guides at an assembly step of engaging the frame to the rear panel.

14 Claims, 8 Drawing Sheets

(56) References Cited

U.S. PATENT DOCUMENTS

| | | | |
|---|---|---|---|
| 2021/0033328 | A1 | 2/2021 | Torres et al. |
| 2021/0404725 | A1 | 12/2021 | Olvera et al. |

FOREIGN PATENT DOCUMENTS

| | | | | | |
|---|---|---|---|---|---|
| JP | H0694339 | A | * | 4/1994 | |
| JP | H09126640 | A | * | 5/1997 | |
| JP | H10320635 | A | * | 12/1998 | |
| KR | 20140144446 | A | * | 12/2014 | ..... F25C 1/24 |
| KR | 20220102770 | A | * | 7/2022 | ..... F25C 1/24 |
| WO | WO-2021042187 | A1 | * | 3/2021 | ..... F25C 1/25 |
| WO | 2021202215 | A1 | | 10/2021 | |

OTHER PUBLICATIONS

Yamamoto et al., Refrigerator, May 16, 1997, JP H09126640 A, Whole Document (Year: 1997).*

Abe et al., Beverage Automatic Vending Machine, Dec. 4, 1998, JPH10320635A, Whole Document (Year: 1998).*

Jin et al., Ice Maker and Refrigerator, Mar. 23, 2016, CN 105423689 A, Whole Document (Year: 2016).*

Youngho et al., Refrigerator, Jul. 21, 2022, KR 20220102770 A, Whole Document (Year: 2022).*

Kim et al., Ice Maker Assembly for Refrigerator, Dec, 19, 2014, KR 20140144446 A, Whole Document (Year: 2014).*

Wang et al., Refrigeration Device, Jan. 8, 2021, CN 112197499 A, Whole Document (Year: 2021).*

* cited by examiner

ICE MAKER ASSEMBLY CONFIGURATION AND COOLING APPLIANCE

CROSS-REFERENCE TO RELATED APPLICATION

This application claims the priority, under 35 U.S.C. § 119, of Turkish patent application TR 2022/012930, filed Aug. 16, 2022; the prior application is herewith incorporated by reference in its entirety.

FIELD AND BACKGROUND OF THE INVENTION

The present invention relates to a cooling appliance provided with an ice maker. In particular, the present invention relates to constructional details of ice maker assemblies for household refrigerators.

A cooling appliance such as a household refrigerator can include one or more ice makers for a facilitated preparation of ice cubes in a designated zone of a respective cooling compartment.

U.S. Pat. No. 11,543,166 B2 and its counterpart International publication WO 2021/202215 A1 disclose an ice maker for cooling appliances. The ice maker in that document includes a carriage, an ice mold defining a plurality of cavities that is movably coupled to the carriage such that the ice mold is movable relative to the carriage between a home position and a harvest position, and a detection lever movably coupled to the carriage such that the detection lever is movable between a retracted position and an extended position, the detection member being biased toward the extended position. The ice maker further includes a retention mechanism configured to retain the detection lever in the retracted position when the ice mold is in the harvest position.

Dimensional limitations with regard to cooling compartments to be furnished with ice makers, renders the procedures related to assembling, maintenance and repair difficult. Therefore, structural solutions are desired in order to facilitate such procedures in assembling and disassembling of ice maker systems for household cooling appliances.

SUMMARY OF THE INVENTION

It is accordingly an object of the invention to provide an ice maker assembly structure which overcomes the above-mentioned and related disadvantages of the prior art devices and methods of this general type.

It is another object of the present invention to propose a solution in which the ice makers can be easily attached to and/or detached from a cooling compartment of a cooling appliance.

Yet a further object of the present invention is to propose a solution in which the attachment/detachment of ice makers can be easily performed even in the case where a respective cooling compartment has a relatively small inner volume.

With the above and other objects in view there is provided, in accordance with the invention, an ice maker assembly configuration for mounting one or more ice makers in a cooling compartment of a cooling appliance, the mounting assembly configuration comprising:

a frame to be engaged with an ice maker, said frame being configured to removably engage with a rear panel of the cooling compartment of the cooling appliance distal from an access opening of the cooling compartment;

a support element to be secured to the rear panel and configured to support said frame against a force of gravity;

said frame having two or more guides at a rear panel-side end of said frame; and said support element being formed with two or more guide channels for receiving and guiding said guides during an assembly step for engaging said frame to said rear panel.

In other words, the present application proposes a cooling appliance having a cooling compartment that can be provided with one or more ice makers. The cooling compartment includes an access opening which can be provided with a door.

The assembly configuration comprises a frame to be engaged to the ice maker. The frame is adapted to removably engage with a rear panel of the cooling compartment distal to an access opening of said cooling compartment. The cooling appliance further comprises a support element for being secured to the rear panel. The support element is arranged for supporting the frame against the force of gravity.

The frame comprises two or more guides at a rear panel side end thereof. The support element comprises two or more guide channels for receiving and guiding said guides at an assembling step of engaging the frame to the rear panel. The co-operation between the guide channels and guides facilitates the attachment/detachment of the ice maker.

In a possible embodiment according to the present invention, the guide channels have one or more sections that are arranged to extend in a horizontal direction when in use. The horizontal arrangement provides that in such sections the guide channels are non-inclined, thereby preventing the guides from unintended sliding along said sections due to the weight of the frame and an ice maker tray attached thereto.

In a possible embodiment, the guide channels include a first section distal to the rear panel, adapted to guide the guides in a horizontal direction at an initial stage of the assembling step. A comparable or similar guidance function inherently applies at a final stage of a disassembling step. So, the attachment/detachment of the ice maker is facilitated.

In a possible embodiment, the guide channels further include a second section in connection with the first section; the second section is transverse to the first section. In other words, the second section is angularly arranged with respect to the horizontal direction, and the guides are elevated when the guides is further guided from the first section into the second section. Hence, the guides and inevitably, the rear panel side of the frame are elevated when the guides is brought from the first section into the second section. With this embodiment, the trajectory of the ice maker at attachment/detachment includes a vertical component. Thus, a facilitated attachment/detachment operation can be conducted even with smaller cooling department volumes. Also, a momentary, inclined position of the ice maker allows intervention to possible cable connections thereof.

In a possible embodiment, the guide channels further include a third section distal to the first section and in connection with the second section; the third section is arranged parallel to the first section. This embodiment provides an increased extent of positional stability to the ice maker when mounted to the support element, in particular at an initial stage of detaching or at a final stage of attaching the frame from/to the cooling appliance.

In a possible embodiment, the guides are provided with respective centering means delimiting a lateral range of motion of the frame in-between the corresponding guide channels. The lateral range of motion is in a lateral direction that is orthogonal to both of the horizontal direction and vertical direction. This embodiment secures the engagement between the guides and respective guide channels, in particular when a distal end of the frame relative to the support element is subjected to mechanical forces with a component in the horizontal direction. Thus, the frame is centred between guide channels at its lateral sides.

In a further exemplary embodiment the frame and/or the respective ice maker can comprise a cable channel for the ice maker. Accordingly, the frame can include an opening for provision of availability to the cable channel. With this embodiment, a technician can interfere to the cable connections of the ice maker, through the opening.

In yet another embodiment, the frame further comprises a cover for reversibly covering the opening. With this embodiment, the cable connections can be protected from surroundings at instances where no interference is performed.

In a possible embodiment, the cover is arranged slidable relative to the frame. Sliding cover does not necessitate separation from the frame when bringing to an open position.

In a possible embodiment, a distal end of the frame—relative to the rear panel—is to be secured to a liner of the cooling compartment. Within this context, the liner can be considered as an upper liner when in use. This embodiment provides that, when attached, the frame is positionally stabilized at the rear panel end thereof by means of the guide channels that receive the respective guides; and further stabilized at the distal end relative to the rear panel by the fastening to the liner.

In a possible embodiment, the frame can comprise one or more extensions extending in a lateral direction that is orthogonal to both of the horizontal direction and vertical direction. The extensions can be adapted to delimit a gravity-related pivotal motion range of the frame around the guides by abutting onto the support element when the guides are in the respective third sections. For instance, when the distal end of the frame is released from the liner, the frame inevitably inclines under gravity by pivoting around the guides in the guide channels (e.g., in the third sections thereof). In such case, this embodiment prevents an uncontrolled pivotal movement in which the ice maker otherwise might collide onto a bottom liner of the cooling compartment.

With the above and other objects in view there is also provided, in accordance with the invention, a cooling appliance, comprising:

- a housing formed with a cooling compartment for receiving one or more ice makers;
- said cooling compartment having a rear panel and an access opening distal from said rear panel;
- a frame to be engaged with an ice maker, said frame having a rear panel-side end configured to removably engage with said rear panel of said cooling compartment;
- a support element secured to said rear panel and configured for supporting said frame against a force of gravity;
- said frame having two or more guides at said rear panel-side end of said frame; and
- said support element being formed with two or more guide channels for receiving and guiding said guides during an assembly step for engaging said frame to said rear panel.

In a preferred embodiment of the invention, an end of the frame that is distal from the rear panel is secured to a liner of the cooling compartment.

The above-noted guides and guide channels are formed to enable a sliding assembly of the ice maker(s) into the cooling compartment and a sliding disassembly of the ice maker(s) out of the cooling compartment.

Other features which are considered as characteristic for the invention are set forth in the appended claims. It should be noted in particular that all of the features described above with reference to the assembly configuration itself equally apply to the cooling appliance as a whole.

Although the invention is illustrated and described herein as embodied in an ice maker assembly structure and in a cooling appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
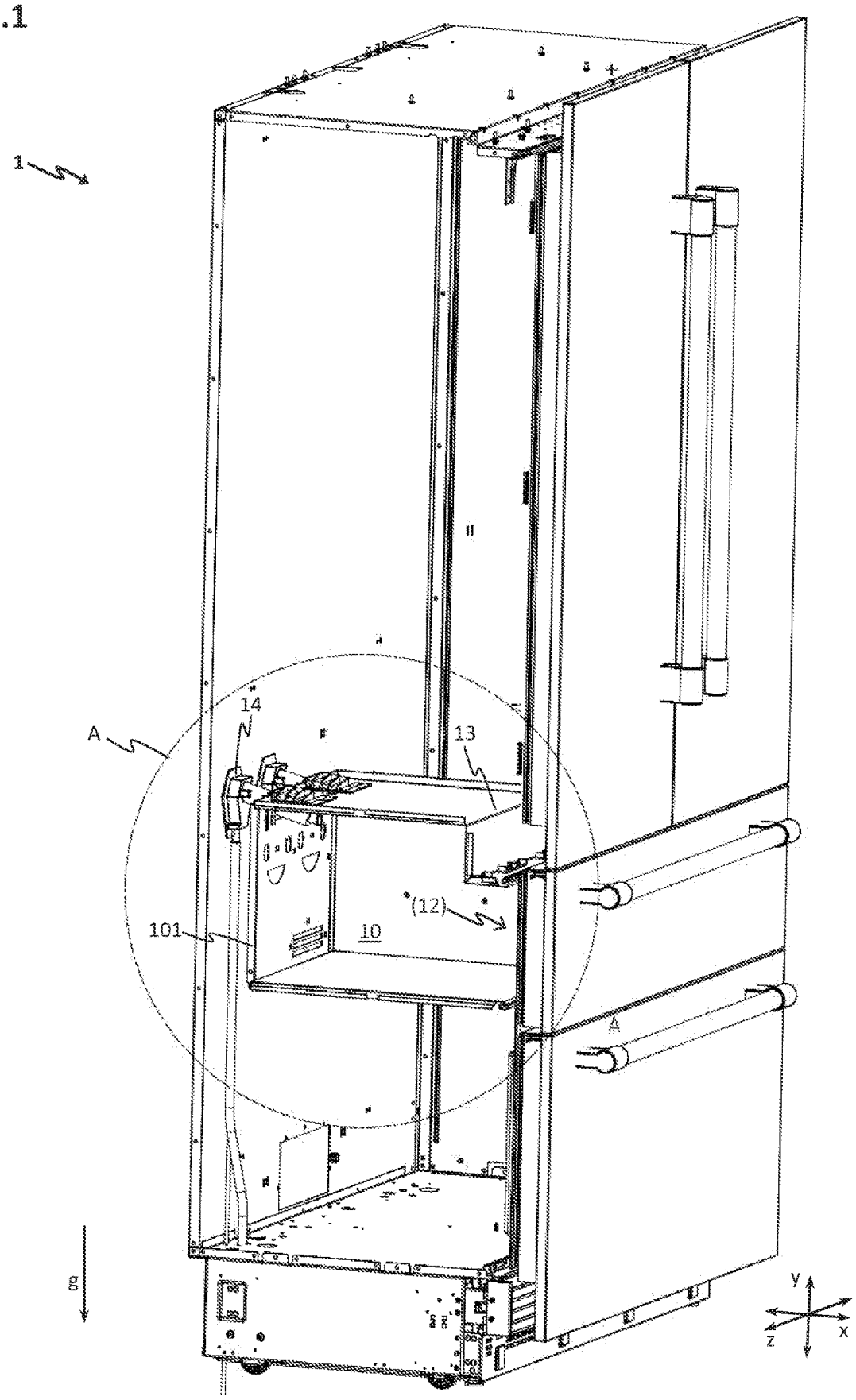
FIG. 1 shows a perspective cutaway view of a cooling appliance according to the present invention.
Figure 2:
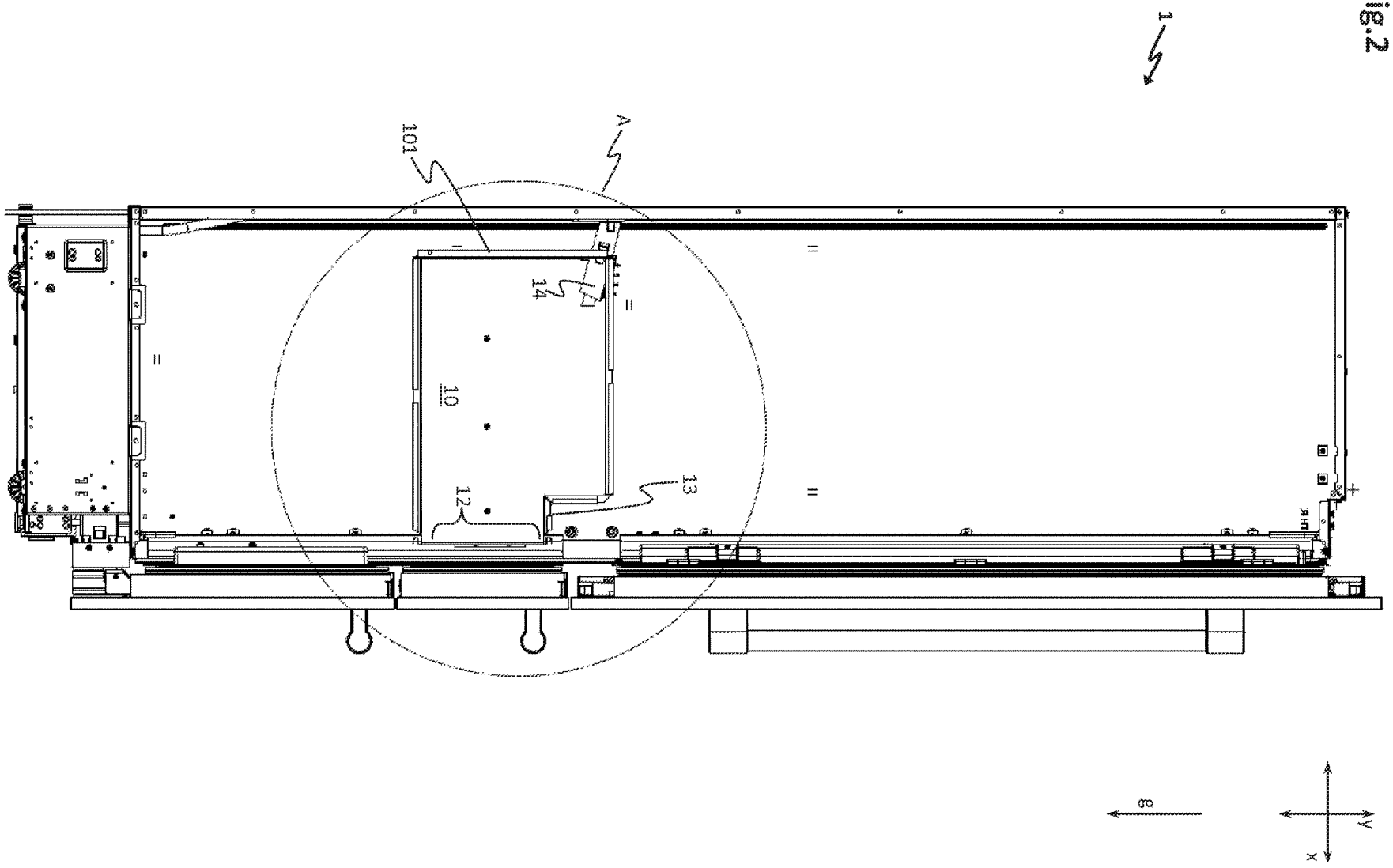
FIG. 2 shows a side cutaway view of the cooling appliance of FIG. 1.
Figure 3:
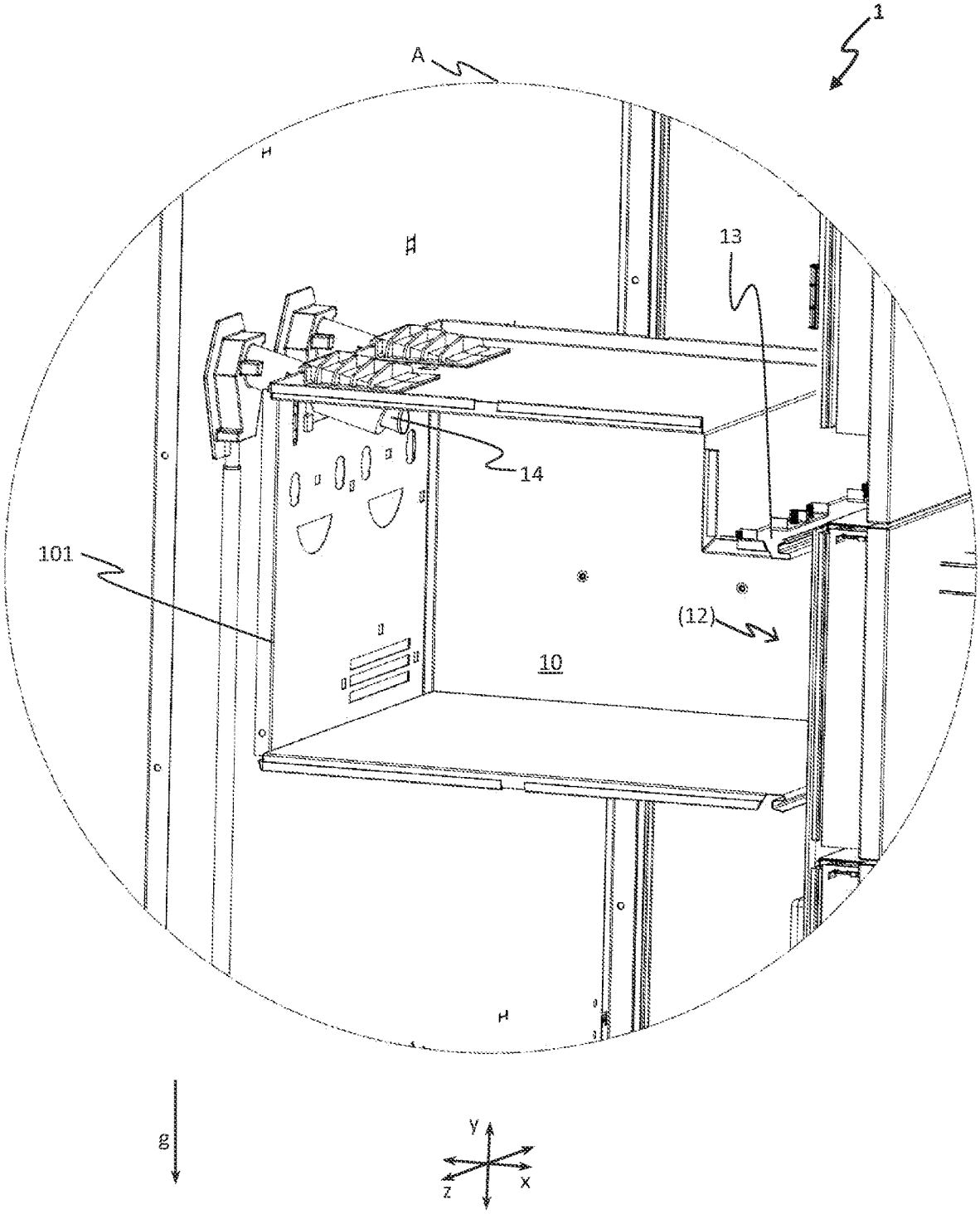
FIG. 3 relates to detail A in FIG. 1, showing a close-up view of the cooling compartment in the cooling appliance according to the present invention.

Referring now to the figures of the drawing in detail, there is shown a cooling appliance (1) having a cooling compartment (10) to be provided with one or more ice makers (11). Within the context of the present application, an ice maker (11) can be considered to include one or more molding vessels (here: ice maker trays) to be fed with water by a water provision apparatus (14), for freezing water under thermal conditions available inside the cooling compartment (10) when in use. FIGS. 1 and 2 respectively show perspective and side cutaway views of an exemplary cooling appliance (1) according to the present invention, with the cooling compartment (10). FIG. 3 pertains to detail A from the FIG. 1, showing a close-up view of the cooling compartment (10) in the cooling appliance (1).

Figure 4:
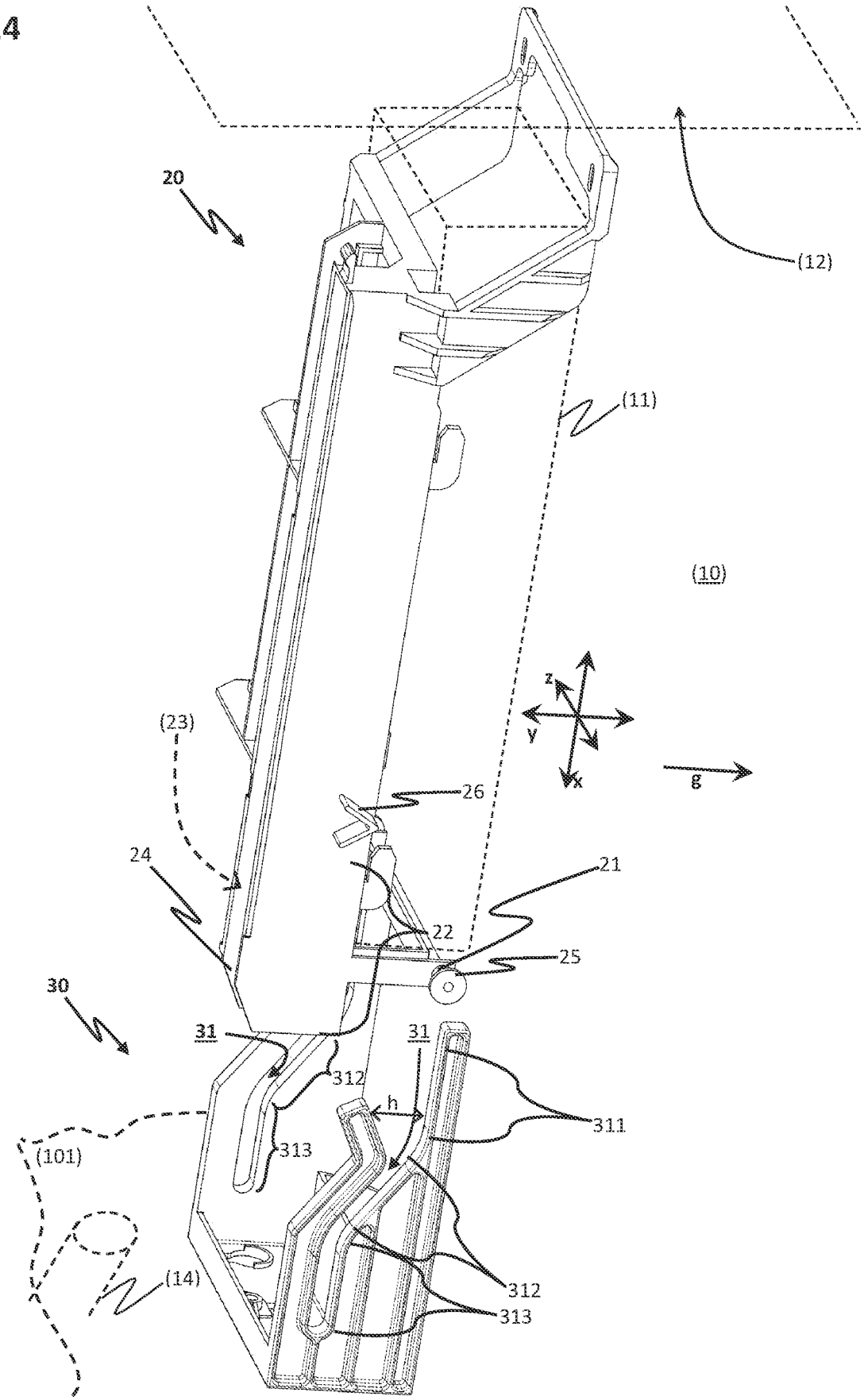
FIG. 4 is a perspective view of an exemplary frame and support element of an ice maker for use in a cooling compartment of the cooling appliance according to the present invention.

FIG. 4 is a perspective view of an exemplary frame (20) and support element (30) for the ice maker (11) that is to be employed in the cooling compartment (10) shown in FIGS. 1 to 3. Referring to FIG. 4, the cooling appliance (1) comprises a frame (20) for being engaged to the ice maker (11). The frame (20) is adapted to removably engage with a rear panel (101) of the cooling compartment (10), that is disposed distal to an access opening (12) of the cooling compartment (10) (cf. FIG. 3). The cooling appliance (1) further comprises a support element (30) for being secured to the rear panel (101). The support element (30) is arranged for supporting the frame (20) against the force of gravity.

The frame (20) comprises two or more guides (21) at a rear panel-side end (22) thereof. The support element (30) comprises two or more guide channels (31) for receiving and guiding said guides (21) at an assembling step by sliding the frame (20) towards the rear panel (101); and also, at a disassembling step by sliding the frame (20) away from the rear panel (101). The guides (21) can be considered in the form of pins or rods, that can extend from lateral sides of the frame (20) in a lateral direction (z) for being received and guided in respective guide channels (31). The guide channels (31) can be considered to be disposed to oppose each of said lateral sides of the frame (20), for symmetrically and Within the context of the present application, the term "assembling" corresponds to engaging the frame (20) to the support element (30), and the term "disassembling" corresponds to disengaging the frame (20) from the support element (30). The mechanically cooperative behaviors and functioning of guides (21) and guide channels (31) during assembly and disassembly can be considered identical in every aspect, other than the direction of movement of the frame (20) (e.g., relative to the rear panel (101)), which is reversed. The co-operation between the guide channels (31) and the guides (21) facilitates the attachment and detachment of the ice maker (11) with respect to the cooling compartment (10), that is, to/from the rear panel (101).

FIG. 5 to FIG. 8 exemplify the stages of an assembly operation of the frame (20) with the ice maker (11) to the support element (30). A reverse order of the stages corresponds to a disassembly operation.

Figure 5:
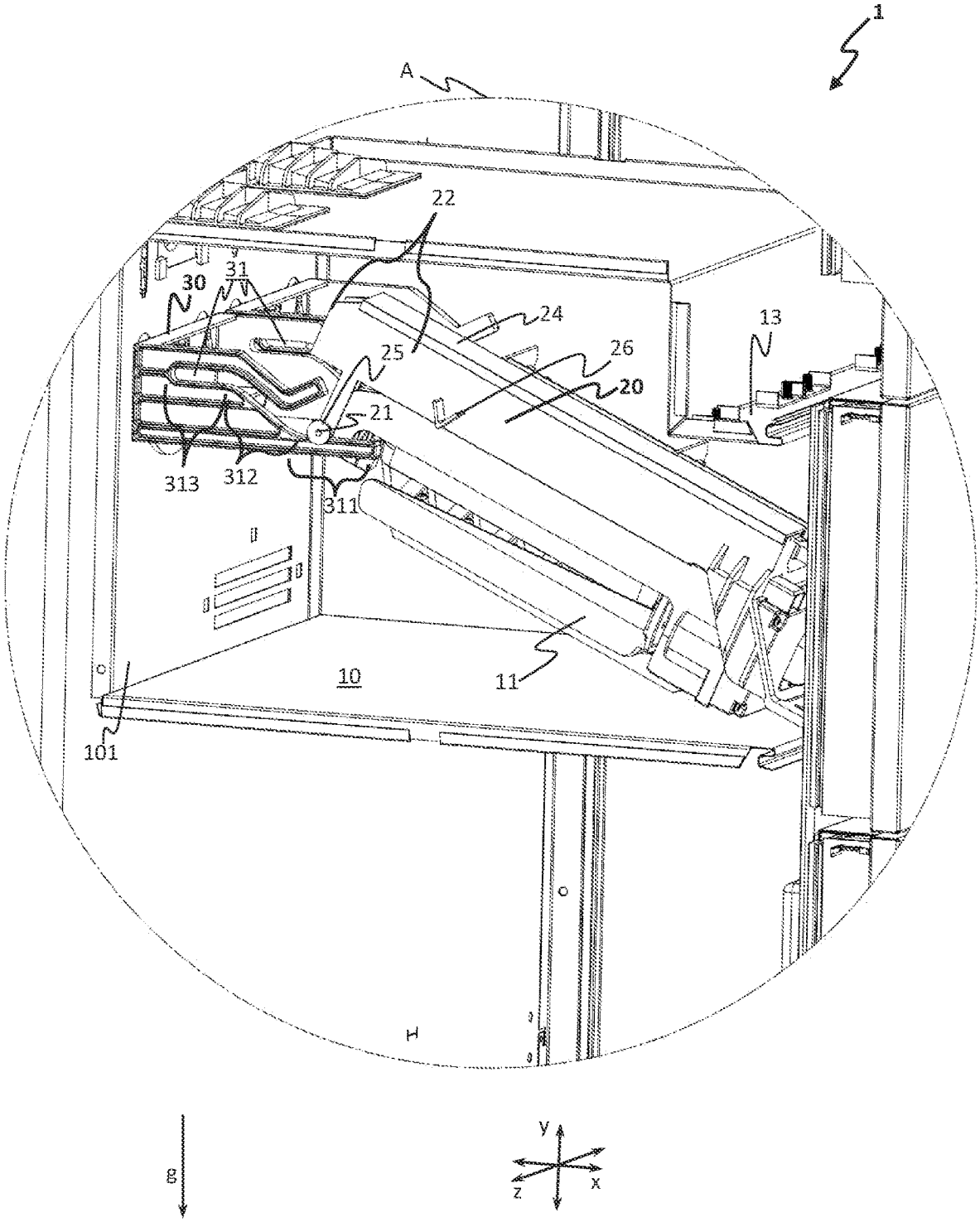
FIG. 5 is a perspective cutaway view corresponding to detail A from FIG. 1, showing an initial stage of an assembly operation, or a final stage of a disassembly operation between the frame and support element.

FIG. 5 is a perspective cutaway view corresponding to detail A in FIG. 1; showing an initial stage of an assembly operation, or a final stage of a disassembly operation between the frame (20) and support element (30). Here, a rear panel-side end (22) of the frame (20) is supported by the support element (30) against gravity (g), via a mechanical communication between the guides (21) and (e.g., a first section (311) of) the guide channels (31). The guides (21) are provided with respective centering means (25) delimiting a lateral range of motion of the frame (20) in-between the corresponding guide channels (31), said lateral range of motion being in the lateral direction (z) that is orthogonal to both the horizontal direction (x) and the vertical direction (y).

Figure 6:
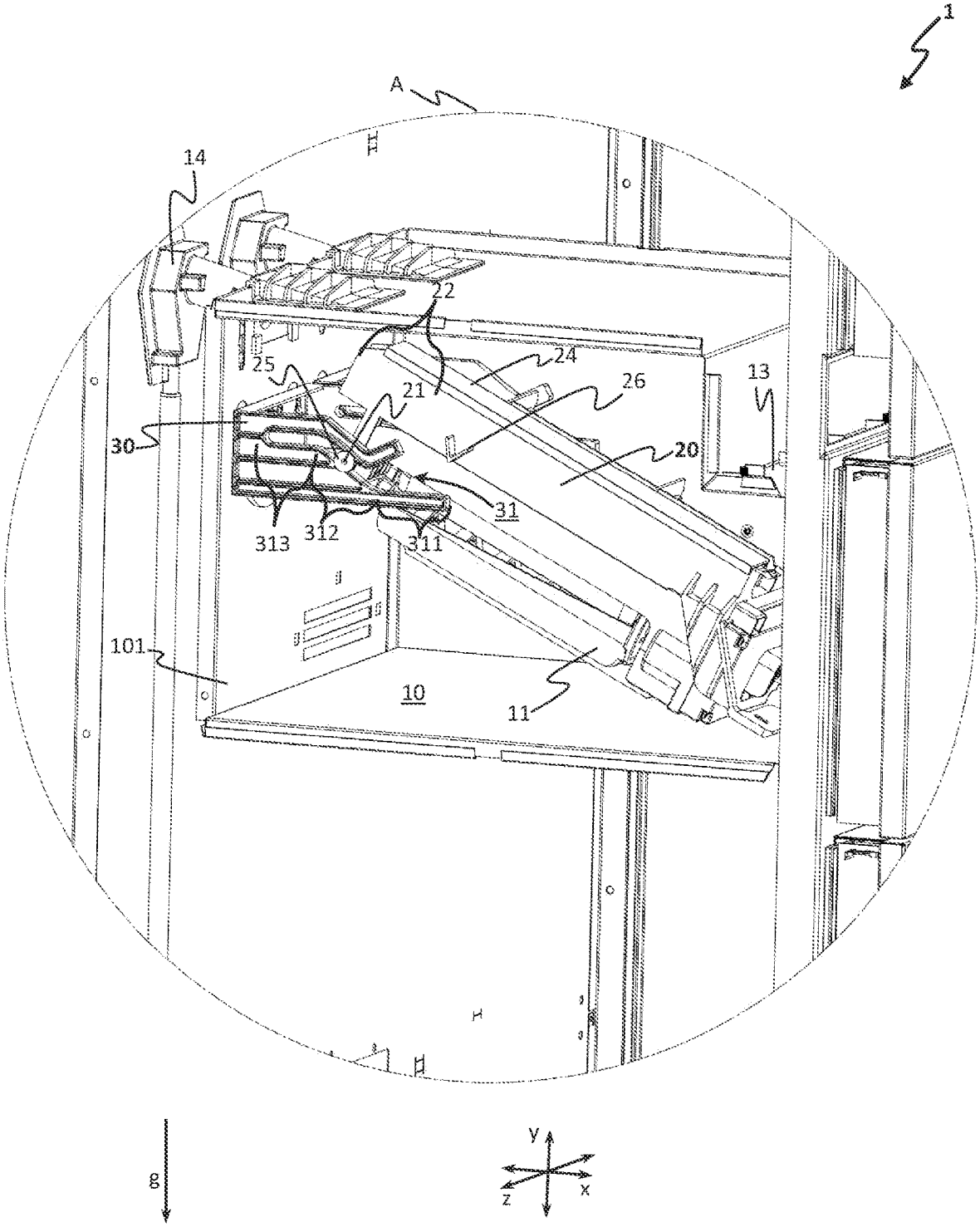
FIG. 6 is a perspective cutaway view corresponding to detail A from FIG. 1, showing a transitional stage of an assembling or disassembly operation between the frame and support element.

FIG. 6 is a perspective cutaway view corresponding to detail A in FIG. 1; showing a transitional stage of an assembly or disassembly operation between the frame (20) and the support element (30). Here;

- the rear panel-side end (22) of the frame (20) is still supported by the support element (30) against gravity (g);
- the guides (21) can be at a second section (312) that is transversely connected to the first section (311), and thus the rear panel-side end (22) of the frame (20) is relatively elevated when compared to that shown in FIG. 5.

Figure 7:
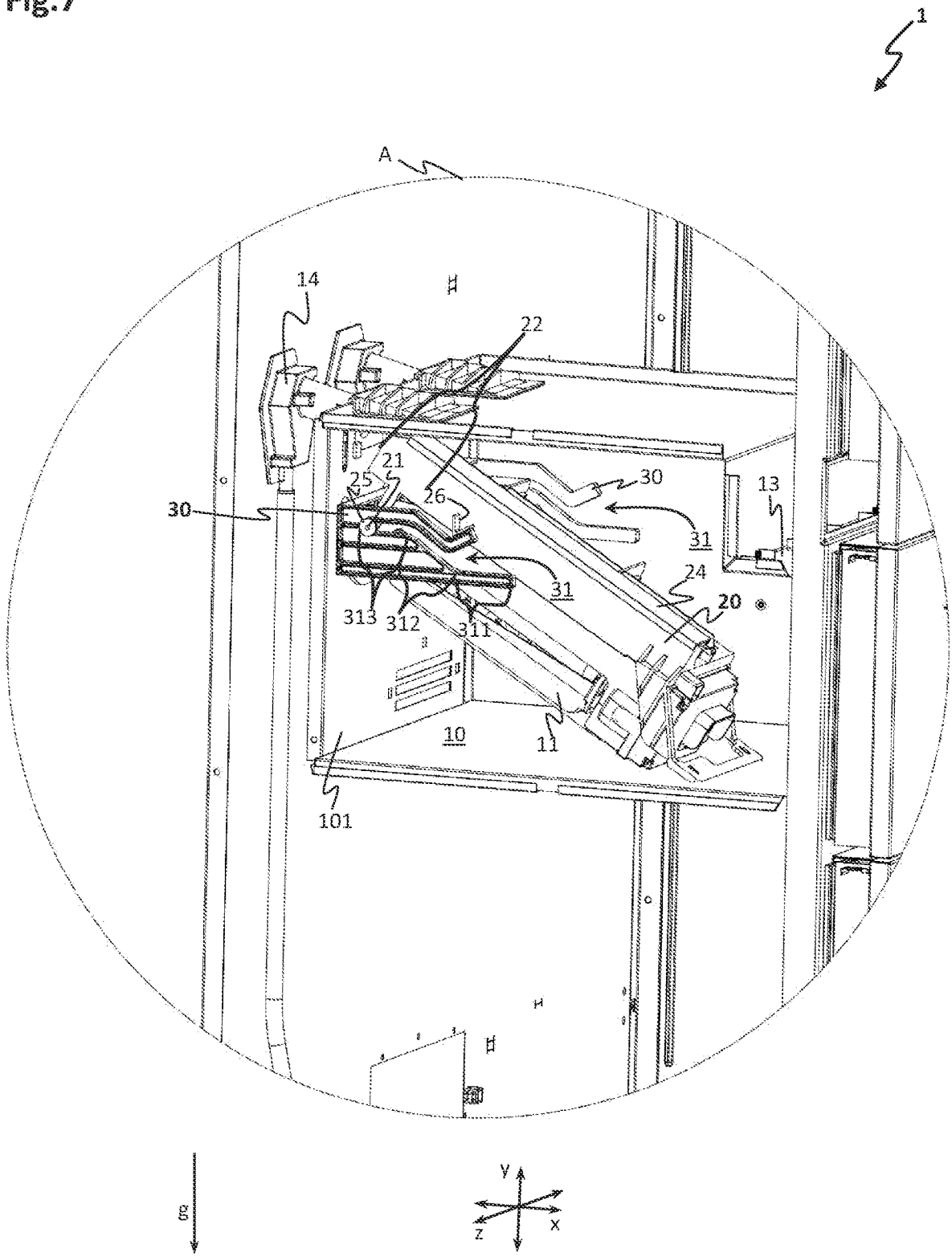
FIG. 7 is a perspective cutaway view corresponding to the detail A from FIG. 1, showing an initial stage of a disassembly operation, or a final stage of an assembly operation between the frame and support element.

FIG. 7 is a perspective cutaway view corresponding to detail A in FIG. 1; showing an initial stage of a disassembly operation, or a final stage of an assembly operation between the frame (20) and support element (30). Here;

- the rear panel-side end (22) of the frame (20) is still supported by the support element (30) against gravity (g);
- the guides (21) can be at a third section (313) that is transversely connected to the second section (312) and is parallel to the first section (311); thus providing a positional stability to the rear panel-side end (22) of the frame (20). In other words, since the third section (313) is horizontal, the guides (21) do not tend to slide along the guide channels (31) under gravity (g).

In a possible embodiment, the frame (20) further comprises one or more extensions (26) extending in the lateral direction (z) that is orthogonal to both of the horizontal direction (x) and vertical direction (y). In such embodiment, the extensions (26) are adapted to delimit a gravity-related pivotal motion range of the frame (20) around the guides (21) by abutting onto the support element (30) when the guides (21) are in the respective third sections (313).

FIG. 7 visually exemplifies how such extension (26) abuts onto the support element (30) under gravity (g). Hence, the pivotal motion range of the frame (20) under gravity (g) is delimited, and a rotational position of the frame (20) is stabilized.

Figure 8:
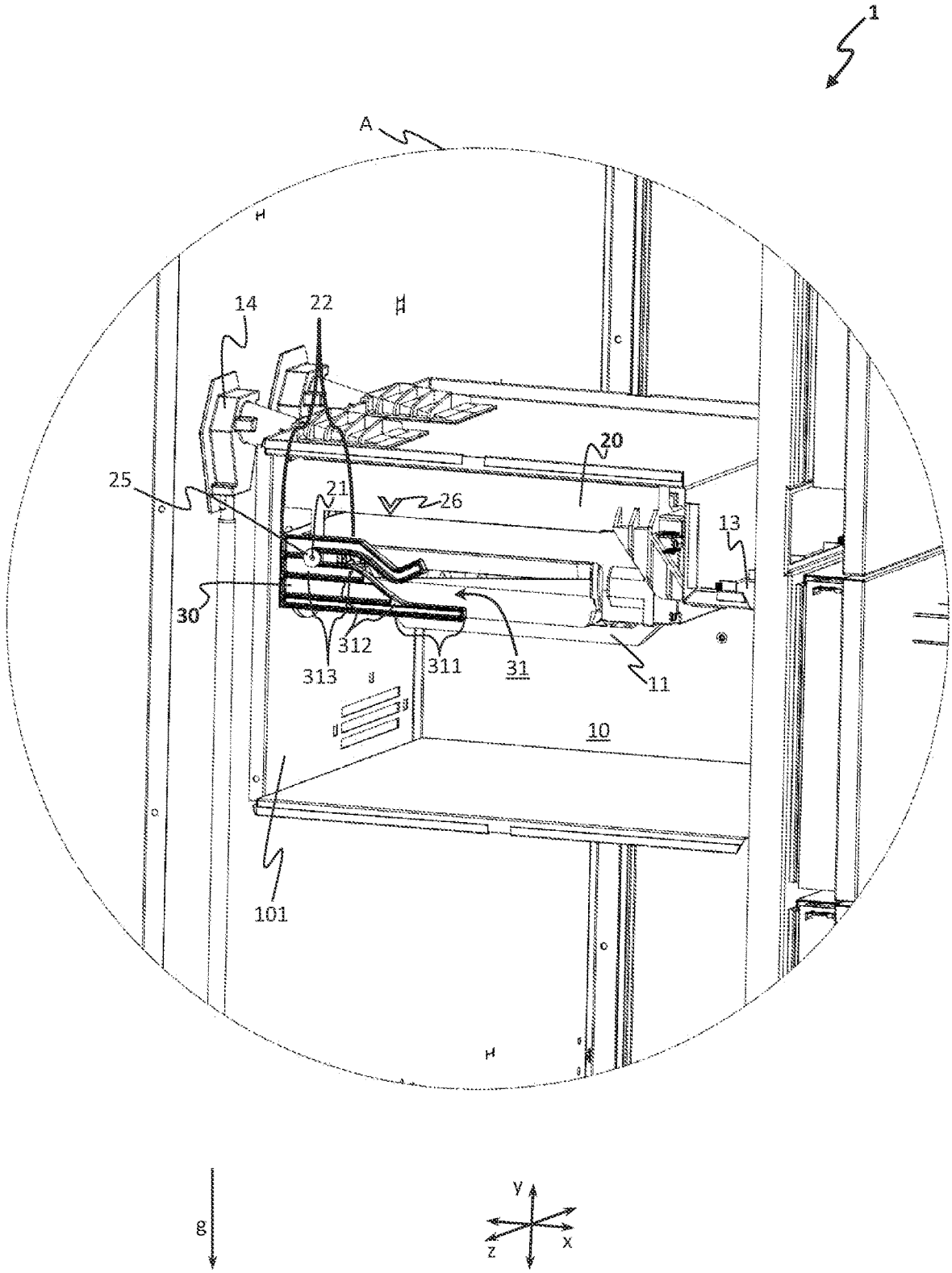
FIG. 8 is a perspective cutaway view corresponding to the detail A from FIG. 1, exemplifying an instance in which the ice maker is ready for use.

FIG. 8 is a perspective cutaway view corresponding to detail A in FIG. 1, exemplifying an instance in which the ice maker (11) is ready for use. Here;

- the frame (20) is pivoted around the guides (21) against gravity (g); and
- the frame (20) is secured to the cooling compartment (10), e.g., to a liner (13) of the cooling compartment (10). For instance, the frame (20) can be secured at an end that is distal to the rear panel (101). Such securing can be arranged, for instance, by a screw connection between the frame (20) and the liner (13) of the cooling compartment (10).

Within the context of the present application, the term "liner" corresponds to an upper liner of the cooling compartment (10) when in use.

The guide channels (31) can be arranged wider at a section distal from the rear panel (101) for facilitated engagement with respective guides (21) at initiation of an assembly operation. For example, in the vertical direction (y) when in use, a height (h) of the guide channels (31) can be greater at the first section (311) when compared to one or more remaining sections thereof (see FIG. 4). Such remaining sections can be the second section (312) and the third section (313) that follow the first section (311) towards the rear panel (101). Such first section (311) can be considered as an entrance section for receiving the guides (21) when initiating an engagement between the guides (21) and the guide channels (31) at assembling of the frame (20) with the support element (30). This measure facilitates the introduction of the guides (21) into the guide channels (31).

The guide channels (31) may have one or more sections that are arranged to extend in a horizontal direction (x) when in use. This measure provides an enhanced positional stability to the respective ice maker, since the horizontal (non-inclined) layout of such section(s) prevent the frame (20) from sliding along such section(s) of the guide channels (31) under the weight of the frame (20) and of a corresponding ice maker (11). This fact also applies at an instance in which the guides (21) are guided into a position in which the frame (20) is not yet secured to the cooling compartment (10) (see FIG. 7). In such instance, the frame (20) is inclined under gravity (g), yet the horizontal arrangement of such section of the guide channel (31) prevents the guides (21) from moving in a direction that has a vertical component. The frame (20) can be then pivoted around a vertical axis of the guides (21), to bring the tray of a respective ice maker (11) into a horizontal position in which the ice maker can be considered operable. Upon reaching said horizontal position, the frame (20) can be secured to the cooling compartment, e.g., at a portion distal to the rear panel-side end (22) (see FIG. 8).

Such positional stability also applies at an instance of detachment of the frame (20) from the cooling compartment (10): when a means (e.g., one or more screws) for securing the frame (20) to the cooling compartment (10) is removed, the frame (20) can pivot around guides (21) under gravity, but takes a stable and stagnant position in terms of sliding in the horizontal direction (x). The horizontally arranged section (e.g., the third section (313)) prevents the guides (21) from moving in a direction that has a vertical component. The frame (20) can be provided with one or more extensions (26) that are arranged to abut onto the support element (30) to delimit a pivotal movement range of the frame (20) under gravity (g) (see FIG. 7).

In relation with the functionality discussed above:

In a possible embodiment, the guide channels (31) can include the first section (311) distal to the rear panel (101), adapted to guide the guides (21) in a horizontal direction (x) at an initial stage of the assembling step. So, an initial step of attachment or a final step of detachment of the ice maker can be performed by an easy, horizontal movement. Thus, the labor costs are decreased.

In a possible embodiment, the guide channels (31) further include the second section (312) in connection with the first section (311); the second section (312) is arranged transverse to the first section (311), such that the guides (and thus the rear panel-side end (22) of the frame (20)) are elevated when further guiding of the guides (21) from the first section (311) into the second section (312). With this embodiment, the trajectory of the ice maker at attachment/detachment includes a vertical component, such that the ice maker can travel at least partially in the vertical direction (y) that can be opposite to the direction of the gravity (g). Thus, a facilitated attachment/detachment operation can be conducted even with smaller cooling department volumes, that is, even with shorter distances between the rear panel (101) and an opposing access opening that can be provided with an access door that closes the cooling compartment to the ambient air. Furthermore, the ice maker takes an inclined position at a relevant stage of attachment or detachment thereof. This allows a facilitated intervention to cables in a possible cable canal, without necessitating a complete detachment of the ice maker from the cooling appliance.

In a possible embodiment, the guide channels (31) further include the third section (313) distal to the first section (311) and in connection with the second section (312); the third section (313) is arranged parallel to the first section (311). With this embodiment, gravity-related movement of the ice maker is avoided at a final stage of attaching or at an initial stage of detaching of the same. Hence, this embodiment provides an increased extent of positional stability to the ice maker. This fact also applies at an instance in which the guides (21) are guided into a respective end position in the third section (313), yet the frame (20) is not yet secured to the cooling compartment. In such instance, the frame (20) is inclined under gravity, yet the horizontal arrangement of the third section (313) of the guide channel (31) prevents the guides (21) from moving in a direction that has a vertical component. The frame (20) can be then pivoted around a vertical axis of the guides (21), to bring a respective ice maker tray into a horizontal position in which the ice maker can be considered operable. Upon reaching said horizontal position, the frame (20) can be secured to the cooling compartment, e.g., at a portion distal to the rear panel-side end (22). Said increased extent of positional stability also applies at an instance of detachment of the frame (20) from the cooling compartment: when a means for securing the frame (20) to the cooling compartment is removed, the frame (20) takes a stable, inclined position under gravity. The horizontally arranged third section (313) prevents the guides (21) from moving in a direction that has a vertical component.

In a possible embodiment, the frame (20) further comprises an opening (23) for provision of availability to a cable channel of the ice maker. With this embodiment, a technician can interfere to the cable connections of the ice maker, through the opening (23). In the case where the cable channel is arranged for supporting the cable connections against gravity, when in use, the opening (23) can be considered as an "upper" opening. In the case where the guide channels (31) include the first section (311) and second section (312) (and possibly, also the third section (313)) as discussed before, the frame (20) takes an inclined position at a relevant stage of attachment or detachment of the ice maker. In such instance, the opening (23) (and possibly, a cover (24) thereof) is easily available for intervention without necessitating a complete removal of the ice maker from the support element (30).

In a possible embodiment, the frame (20) further comprises a cover (24) for reversibly covering the opening (23). With this embodiment, the cable connections can be protected at instances where no such interference is required on cable connections of the ice maker.

In yet another possible embodiment, the cover (24) is arranged slidable relative to the frame (20). With such a slidable cover (24), the cover (24) can be moved between an open position and closed position without necessitating a separation of the cover (24) from the frame (20).

The following is a summary list of reference numerals and the corresponding structure used in the above description of the invention:

1 cooling appliance
10 cooling compartment
11 ice maker
12 access opening
13 liner
14 water provision apparatus
20 frame
21 guides, guiding means
22 rear panel-side end
23 opening
24 cover
25 centering means
26 extension

30 support element
31 guide channel
101 rear panel
311 first section
312 second section
313 third section
x horizontal direction
y vertical direction
z lateral direction
g gravity
h height

The invention claimed is:

1. An ice maker assembly configuration for mounting one or more ice makers in a cooling compartment of a cooling appliance, the assembly configuration comprising:

a frame to be engaged with an ice maker, said frame being configured to removably engage with a rear panel of the cooling compartment of the cooling appliance distal from an access opening of the cooling compartment;

a support element to be secured to the rear panel and configured to support said frame against a force of gravity;

said frame having two or more guides at a rear panel-side end of said frame;

said support element being formed with two or more guide channels for receiving and guiding said guides during an assembly step for engaging said frame to said rear panel;

only said two or more guides at the rear panel-side end of said frame interacting with said two or more guide channels such that said frame may be inclined under gravity relative to said guide channels; and a length of said support element in a horizontal assembly direction being less than a length of said frame in the horizontal assembly direction such that said support element does not extend to an end of said frame distal from said rear panel of said cooling compartment when said frame is engaged with said rear panel of said cooling compartment.

2. The assembly configuration according to claim 1, wherein said guide channels are formed with one or more sections that extend in a horizontal direction when in use.

3. The assembly configuration according to claim 2, wherein said guide channels are formed with a first section distal to said rear panel, for guiding said guides in a horizontal direction at an initial stage of the assembly step, and to support said frame at the initial stage against gravity.

4. The assembly configuration according to claim 3, wherein said guide channels further are formed with a second section adjoining said first section, said second section being inclined relative to said first section, such that, when in use, said second section is inclined with respect to the horizontal direction, and said guides are elevated when said guides are further moved from said first section into said second section.

5. The assembly configuration according to claim 4, wherein said guide channels further are formed with a third section distal from said first section and adjoining said second section, and said third section is parallel to said first section.

6. The assembly configuration according to claim 1, wherein said guides are provided with respective centering means configured to delimit a lateral range of motion of said frame in-between corresponding said guide channels, said lateral range of motion being in a lateral direction that is orthogonal to the horizontal direction and a vertical direction.

7. The assembly configuration according to claim 1, wherein said frame is further formed with an opening for a cable channel of the ice maker.

8. The assembly configuration according to claim 7, wherein said frame further comprises a cover for reversibly covering said opening.

9. The assembly configuration according to claim 8, wherein said cover is slidably mounted relative to said frame.

10. The assembly configuration according to claim 1, wherein a distal end of said frame, with regard to the rear panel, is configured for attachment to a liner of the cooling compartment.

11. The assembly configuration according to claim 1, wherein said frame comprises one or more extensions extending in a lateral direction that is orthogonal to the horizontal direction and a vertical direction; said extensions being configured to delimit a gravity-related pivotal range of motion of said frame around said guides by abutting onto said support element when said guides are in a given sections of said guide channels.

12. A cooling appliance, comprising:

a housing formed with a cooling compartment for receiving one or more ice makers;

said cooling compartment having a rear panel and an access opening distal from said rear panel;

a frame to be engaged with an ice maker, said frame having a rear panel-side end configured to removably engage with said rear panel of said cooling compartment;

a support element secured to said rear panel and configured for supporting said frame against a force of gravity;

said frame having two or more guides at said rear panel-side end of said frame;

said support element being formed with two or more guide channels for receiving and guiding said guides during an assembly step for engaging said frame to said rear panel;

only said two or more guides at the rear panel-side end of said frame interacting with said two or more guide channels such that said frame may be inclined under gravity relative to said guide channels; and a length of said support element in a horizontal assembly direction being less than a length of said frame in the horizontal assembly direction such that said support element does not extend to an end of said frame distal from said rear panel of said cooling compartment when said frame is engaged with said rear panel of said cooling compartment.

13. The cooling appliance according to claim 12, wherein an end of said frame distal from said rear panel is secured to a liner of said cooling compartment.

14. The cooling appliance according to claim 12, wherein said guides and said guide channels are formed to enable a sliding assembly of the ice maker into said cooling compartment and a sliding disassembly of the ice maker out of said cooling compartment.

* * * * *